US009414978B2

(12) United States Patent
Agajanian

(10) Patent No.: US 9,414,978 B2
(45) Date of Patent: Aug. 16, 2016

(54) BED

(71) Applicant: Sarkis Agajanian, Los Angeles, CA (US)

(72) Inventor: Sarkis Agajanian, Los Angeles, CA (US)

( * ) Notice: Subject to any disclaimer, the term of this patent is extended or adjusted under 35 U.S.C. 154(b) by 191 days.

(21) Appl. No.: 14/451,425

(22) Filed: Aug. 4, 2014

(65) Prior Publication Data

US 2016/0030263 A1 Feb. 4, 2016

Related U.S. Application Data

(60) Provisional application No. 61/861,816, filed on Aug. 2, 2013.

(51) Int. Cl.
*A61G 7/00* (2006.01)
*A61G 7/057* (2006.01)

(52) U.S. Cl.
CPC ..... *A61G 7/05761* (2013.01); *A61G 7/057* (2013.01); *A61G 7/05746* (2013.01); *A61G 7/05769* (2013.01)

(58) Field of Classification Search
CPC ..... A61G 7/00
USPC ..... 5/710, 713, 933, 644
See application file for complete search history.

(56) References Cited

U.S. PATENT DOCUMENTS 6,829,797 B2 * 12/2004 Partian ..... A61G 7/057 5/710
2012/0060294 A1 * 3/2012 Dzioba ..... A61G 7/05776 5/655.3

* cited by examiner

*Primary Examiner* — Fredrick Conley
(74) *Attorney, Agent, or Firm* — Kleinberg & Lerner, LLP; Marvin H. Kleinberg; Marshall A. Lerner

(57) ABSTRACT

The present invention is plurality of telescoping tubes which are supported by air pressure. The telescoping tubes are used as a support system for a bed, and namely, a hospital bed. The telescoping tubes have a spring system in areas where air pressure is not required, and air pressure may be controlled in a precise manner so as accommodate the patient in a specific manner. A laminate or fitted sheet with a plurality of apertures may be fitted on the top of the tubes so as to provide added support and to absorb bed soiling. The telescoping tubes either as a whole bed or in part, may be easily placed into a sanitizing system that extends the life of the bed and reduces the transmission of communicable diseases.

20 Claims, 9 Drawing Sheets

BED

This application claims the benefit of U.S. Provisional Application No. 61/861,816 filed on Aug. 2, 2013.

BACKGROUND OF THE INVENTION

1. Field of the Invention

The present invention relates to fluid based support systems and, more particularly, to a pressurized bed for the support of hospitalized patients.

2. General Background and State of the Art

The concept of a patient floating on an air cushion has been implemented by many organizations providing complex and sophisticated beds. Some have used inflatable cushions and other approaches have used plastic beads which are supported by a pressurized air flow. Yet, all such beds are unable to provide adequate support to the patient that significantly reduces the chances of discomfort and bed sores.

All such beds have problems with maintaining a sanitary environment, especially with incontinent patients. Incontinence leads to soiling of the bed and prior to this invention, soiled beds may leave patients lying in unsanitary conditions there is no way to effectively allow the waste to drain away from the patient. Cleaning of such beds is also ineffective as residual waste remains within the bed's crevices and materials. Such residual waste comes into contact when the bed is given to another patient whereby there is a chance of passing along potentially communicable diseases to the next patient.

Other problems have involved mechanical failures for beds with a unitary control system. If the bed's control system fails, the entire bed is not useable. In some other beds, there is only one type of support system. If the support system fails, there is no back-up support system which leaves the patient in discomfort for a period of time.

The above described features and advantages of embodiments of the present invention will be more fully appreciated with reference to the accompanying Figures.

INVENTION SUMMARY

According to the present invention, a plurality of telescoping tubes is supported by air pressure. Much as a "bed of nails" can support the human body without injury, with a sufficient number of tubes, the weight that each tube bears is light enough so that a moderate air pressure in each tube will be adequate. Support springs are provided at the base of each tube to support the body weight should the air supply fail or be turned off.

Each tube can be supplied with air exit apertures near the top for the circulation of air about the resting body. In alternative embodiments, the apertures can be on the body of the tube or in the top of the tube. At the base of each tube is an internal gasket to prevent air loss at the base and to redirect incoming air to elevate the tube and exit near the top. At the top of each tube, a collar is provided to support a bed sheet which has been apertured to fit around the tubes.

A plurality of air supply tubes is mounted to a plenum unit which is connected to an air supply through a quick release valve. A bed may have several plenum units and the plenum units can be arranged in an array of rows, each individually actuable so that different areas of the bed can have different levels of support for a body.

The several plenum units are mounted in a frame with a resilient collar so that limited vertical motion is possible. In conjunction with the plenum units, a roller bar can be moved under the plenum units to sequentially elevate them slightly to provide a rippling motion to the person being supported in the bed. The massaging roller bar can be programmed to provide different combinations of movement to stimulate the person in the bed.

The present invention also provides for an easy and effective means of sanitizing the hospital bed components. Portions or the entire system can be placed in a series of tubs. The first tub functions to soak the soiled bed components in sanitizing liquid for both the break down of soiled debris and disinfection of microbial residue. The second tub functions to rinse off the debris and cleaning liquid. The final tub functions to dry the cleaned bed components and further sanitize the bed components under ultraviolet (UV) radiation. The tubs are configured to have clear observation panels for easy evaluation of the cleaning process.

The above invention also saves on costs. Previous hospital bed models that are soiled or damaged usually have to be destroyed resulting in added cost to buy new beds. The above invention has replaceable segments. And such segments may be individually sanitized in a manner that allows them to be reused. Thus, the life cycle of the present invention and the ease in repair or replacement allows for a much more cost effective alternative. Furthermore, the pressure controls are far more precise and can provide or limit air pressure to the patient, thereby reducing health care costs associated with bed sores and related injuries.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

BRIEF DESCRIPTION OF THE DRAWINGS

FIG. 3 including

FIG. 4, including

FIG. 7 including

FIG. 8, including FIG. 9, including

DETAILED DESCRIPTION OF THE PREFERRED EMBODIMENTS

Figure 1:
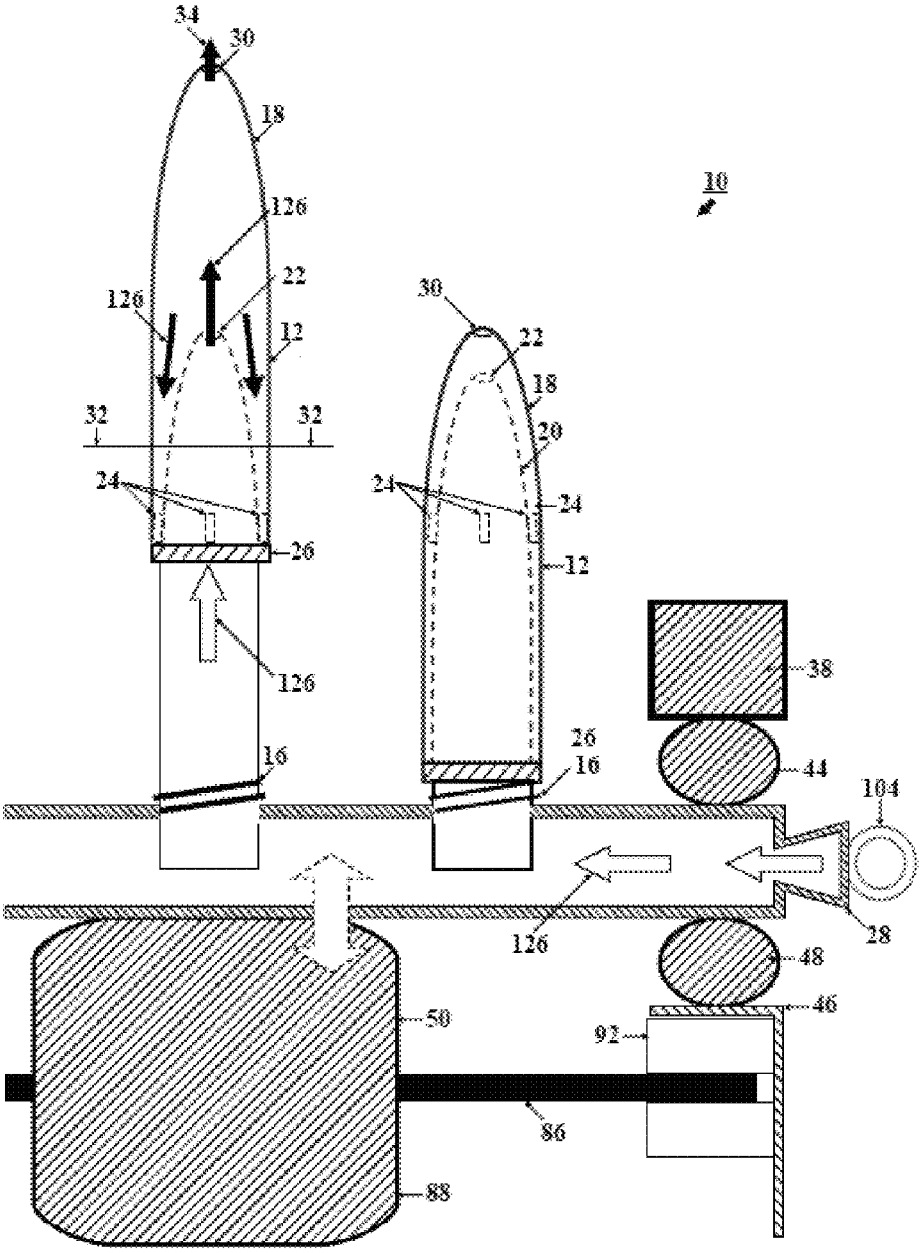
FIG. 1 is a side sectional view of a portion of a bed utilizing support tubes according to the present invention.

Turning first to FIG. 1, there is shown a portion of a bed 10 in sectional view with a detailed showing of a row of support tubes 12 in a plenum chamber 14. As shown, the plenum chamber 14 is supported by resilient spring members 16 which permits limited vertical displacement of the plenum chamber 14. In a preferred embodiment, the spring member 16 can be an elastomeric resilient pillow or, in alternative embodiments can be a double convex spring member.

Each support tube 12 may have an outer tube 18 and an inner tube 20. The support tubes 12 have relatively closed ends facing the top surface of the bed, and the ends of the support tubes 12 may have a variety of shapes for example, dome shaped to planar. The support tubes 12 may be of any materials that are capable of providing comfortable support to a patient and at least some component of support tubes 12 are moveable upon application of air pressure. Such materials may range from metals and metal alloy components (e.g. silver), plastics, foams, and foams with laminate coverings. It is preferred that the materials for said support tubes 12 are have antibiotic properties and are sanitizable and sustainable materials.

Figure 2:
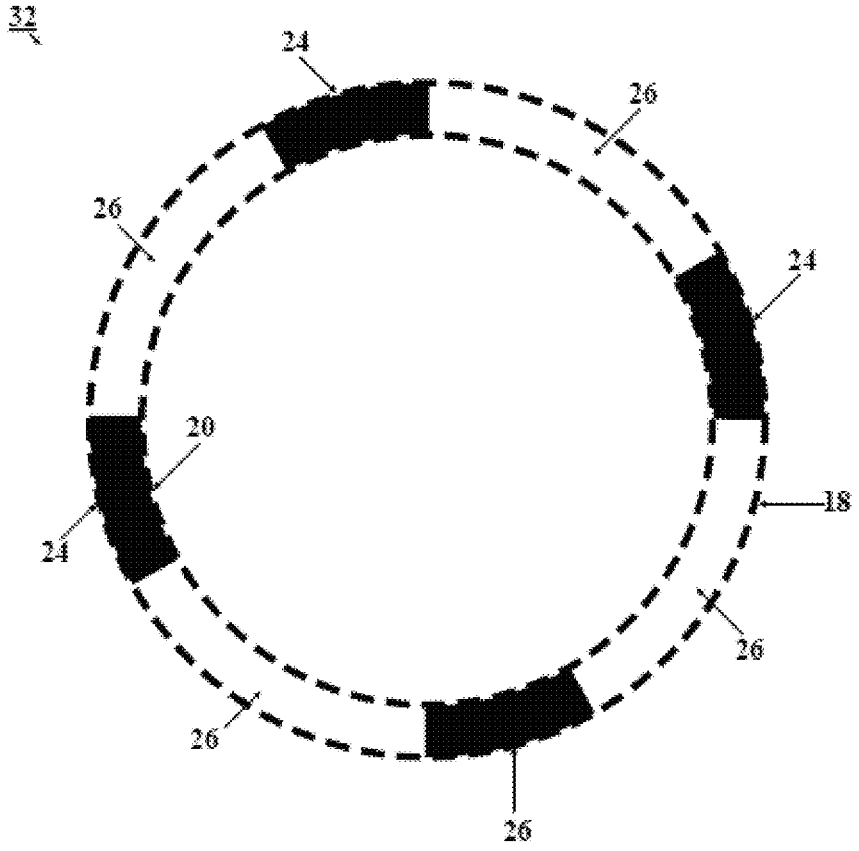
FIG. 2 is a top view of a cross section of a support tube in FIG. 1.

The inner tube 20 has at least one orifice 22 at the top which allows passage of air 126 through the inner tube 20 and into the outer tube 18. Air 126 from an air pressure source 104 is pumped through the quick release-valve 28, and into plenum chamber 14, which the air 126 enters the inner tube 20, and the outer tube 18. When air 126 enters outer tube 18, the outer tube may be raised upwardly such that it may provide support to the patient lying on the plurality of rows of supporting tubes 12. For better "piston-like" operation of the outer tube 18 moving over the inner tube 20, the inner tube 20 may have one or more external fins 24. The external fins 24 may act as a guide, and may act to provide some friction between interior surface of the outer tube 18 and the exterior surface of the inner tube 20. The outer tube 18 may have an inner collar 26 located at the bottom end of the tube. The inner collar 26 may be used to prevent the outer tube 18 from rising beyond the external fin 24 where the inner collar 26 would abut up against the bottom portion of the external fin 24 which is also shown in FIG. 2, a top view of the cross section 32 as shown in FIG. 1.

In FIG. 1, the outer tube 18 also may also have at least one orifice 30. The orifice 30 may be located at the top of the outer tube 18, or located at the side of the outer tube 18. The air flow 34 as designated by an arrow from the orifice 30 of the outer tube 30 which may interact with the patient's body. The air flow 34 may provide warm or dry air which may aid in the patient's circulation or help prevent the accumulation of moisture. To help reduce dehydration caused by the applied air, the orifice 30 may be located on the sides of the outer tube 18 such that the air flow 34 is indirect to the patient.

Figure 3A:
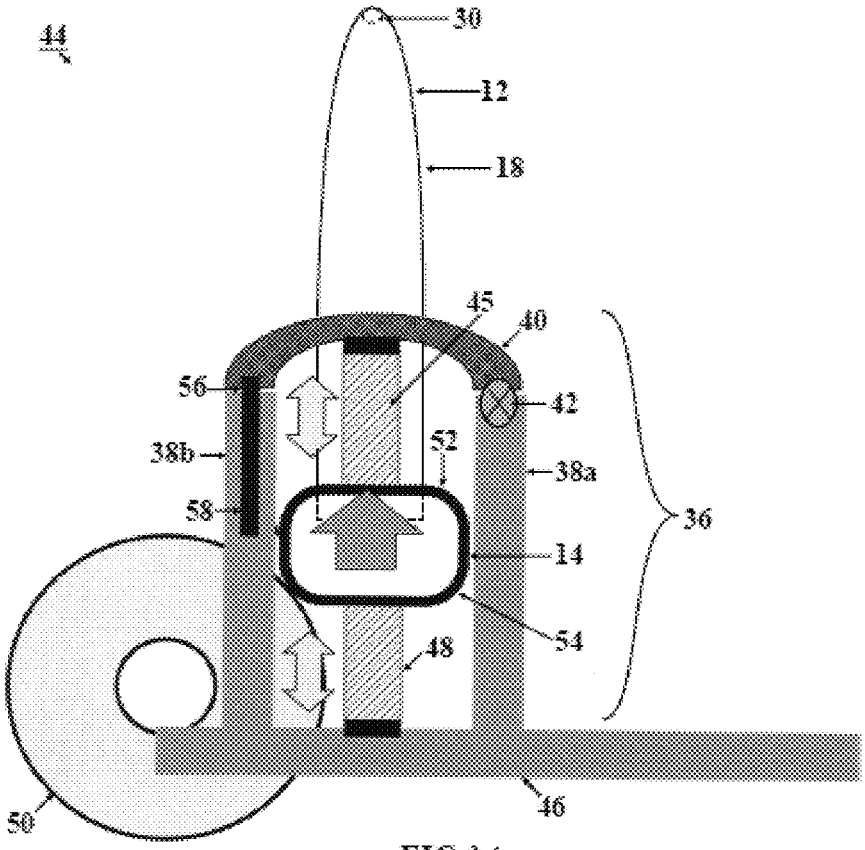
FIG. 3A and FIG. 3B, is a set of views of an alternative embodiment of the present invention.
Figure 3B:
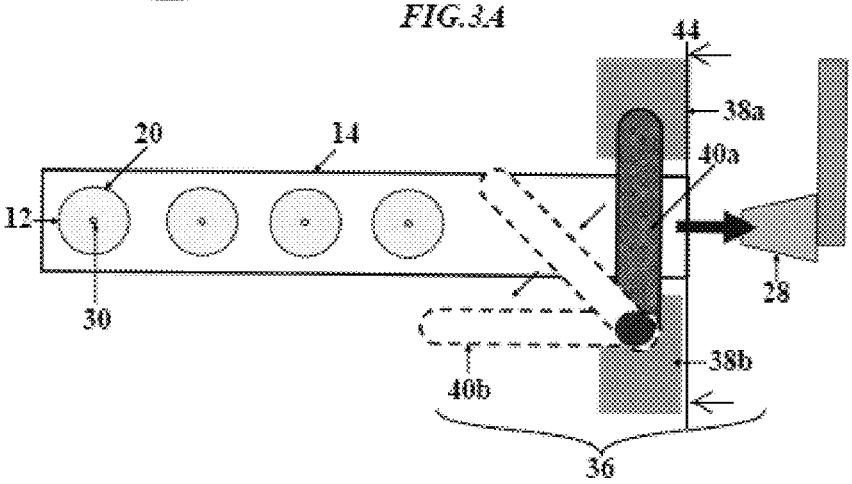

Each plenum chambers 14 may be held in place by a yoke mechanism 36 as shown in FIG. 3A and FIG. 1. The yoke mechanism 36 may comprise framing walls 38*a* and 38*b* and a clamp 40*a*. The clamp 40*a* may lock the plenum chamber 14 by a spring-ball lock 42 or be unlocked as in FIG. 3B, the cross sectional view of line 44 in FIG. 3A.

Attached to the bottom surface of the clamp 40 is the upper spring 45. When the clamp 40*a* is released, the clamp 40*a* may be lifted up and rotated away from the plenum chamber 14 to position 40*b* so that the movement of the clamp 40*b* permits the plenum chamber 14 to be lifted out of the yoke mechanism 36. The clamp 40*a* may be attached to a hinge 56 which has a shaft 58 positioned within the framing wall 38*b*, and the hinge 56 may allow the clamp 40*a* to be rotated to the position of the clamp 40*b*. Upon rotation of the clamp 40*b*, the shaft 58 may be raised. (not shown)

In releasing the plenum chamber 14, the plenum chamber 14 may slide away and out from the quick the release valve 28. The yoke mechanism 36 further has a base 46 wherein said base 46 has a connected lower spring 48. The lower spring 48 and the upper spring 44 allow the plenum chamber 14 to have a limited vertical movement contact with a massaging roller bar 50 when the plenum chamber 14 is locked into place. The plenum chamber 14 may have an outer structure 52 that has rounded edges 54. The rounded edges 54 allows the roller bar 50 to roll under the plenum chamber 54 wherein the roller bar 50 initially makes partial contact to a lower area of the outer structure 52 of plenum chamber 14 and then causes the plenum chamber 14 to be displaced vertically upward as the roller bar 50 moves underneath the plenum chamber 14.

Figures 4A, 4B, 4C:
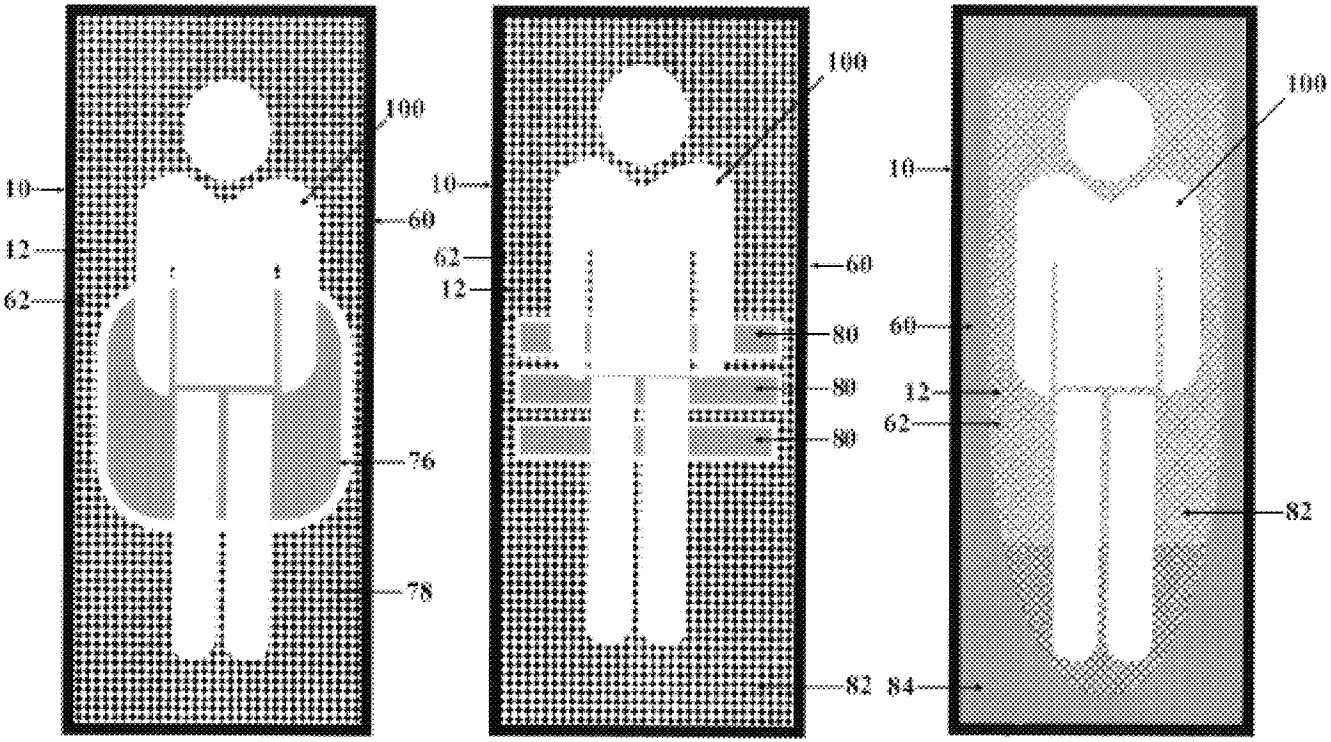
FIGS. 4A, 4B and 4C is a set of idealized top views of a bed with a person illustrating alternative pressure patterns.
Figure 5:
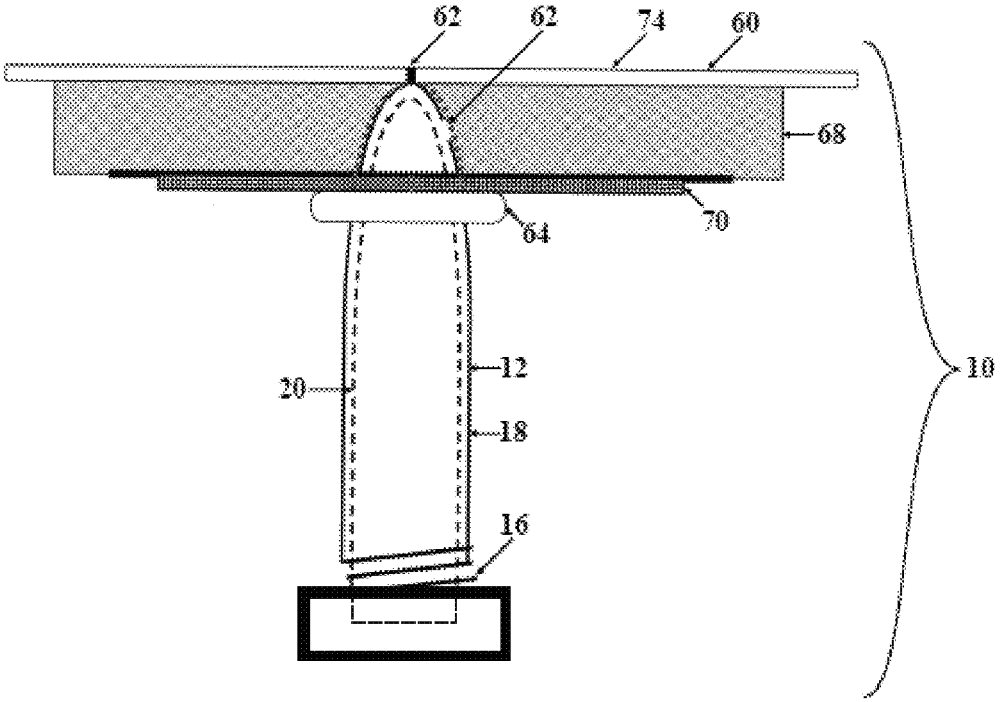
FIG. 5 is a side sectional view of a sheet suitable for use with the support tubes.

The top of the bed 10 may have a laminate or fitted sheet 60 with a plurality of apertures 62 where the apertures 62 would fit around each support tube 12 as shown in FIG. 4A-C. The sheet 60 may be rolled from one end of the bed 10 to the other end, and then pushed atop the support tubes 12. The sheet 60, prior to being rolled on to the support tubes 12, may have apertures 62 that are not yet fully opened, but rather closed using perforations. (not shown). Once the sheet pushed down on atop the support tubes where the perforations are aligned with the tubes 12, the perforations are opened up into apertures 62 that fit and hold the support tubes 12 into place. Each support tube 12 may be connected to an affixed collar barrier 64 as shown in the exemplary embodiment of FIG. 5 where said collar barrier 64 is attached to the outer tube 18, and configured to be above plenum chamber 14, but below top of the outer tube 18. The collar barrier 64 acts to hold the sheet 60 in place and prevents the sheet 60 from falling lower than the level of the collar barrier 64. The sheet 60 may also be used to provide support to each support tube 12.

The sheet 60 may be a multiple layer sheet 74 which may comprise of a top cotton or linen sheet layer 66, a lower absorption membrane 68 which may be of materials known to those with ordinary skill in the art, and a lower fluid barrier 70 which may be of materials that are water resistant. Between the absorption membrane 68 and the fluid barrier 70, there may be a moisture and temperature sensing film 72. Such film 72 may be of capacitive material that may be connected to sensors that detect humidity and temperature levels, and communicate that information to a computer, which then alerts the caretakers of such conditions. (Not shown).

The multiple layer sheet 74 may be used in all areas of the bed, or it may be used in select locations 76 as shown in FIG. 4A. It shall be understood that the select locations 76 may or may not have apertures 62 for housing the support tubes 12. Other locations may be non-absorbent areas 78 wherein the sheet 60 may not have the absorption membrane 68 and may not have the fluid barrier 70. Such non-absorbent areas 78 may be areas that are commonly known by those with ordinary skill in the art as areas which patient 100 would not normally soil.

Some areas may have less pressure than other areas that are pressure reduction zones 80, as shown in FIG. 4B. The pressure reduction zones 80 may have support tubes 10 but the supplied air pressure is far less than the full strength air-supply zones 82. Such pressure reduction zones 80 may be placed in areas that are commonly known by those with ordinary skill in the art to provide more comfort to the patient 100. In an alternative embodiment in FIG. 4C, the bed may have no air-supply zones 84. Such zones would not have the support tubes 10, but rather springs or other modes of elastic support.

Certain regions on the patient 100 may be areas that should not receive any pressure. To allow for selective application of pressure, the bed 10 may be configured with sensing receivers that are located below the laminate sheet 60 that detects certain materials such as but are not limited to, luminescent material. (Not shown) The material may be mixed in with non-toxic paint wherein one may paint the regions on the sheet 60 or patient. The sensing receivers may then send signals to a CPU and communicates to the CPU the location in which pressure on the bed should not be applied. The CPU then regulates the air flow to each plenum chamber 14 segments. (Not shown) The CPU then signals the solenoids for each plenum chamber 14 segments to be active and inactive, and the inactive regions would correspond to the location of the painted area. Painting the regions on the body of the patient 100 allows for better responsiveness as the location of the inactive plenum chambers moves with the patient 100.

Figure 6:
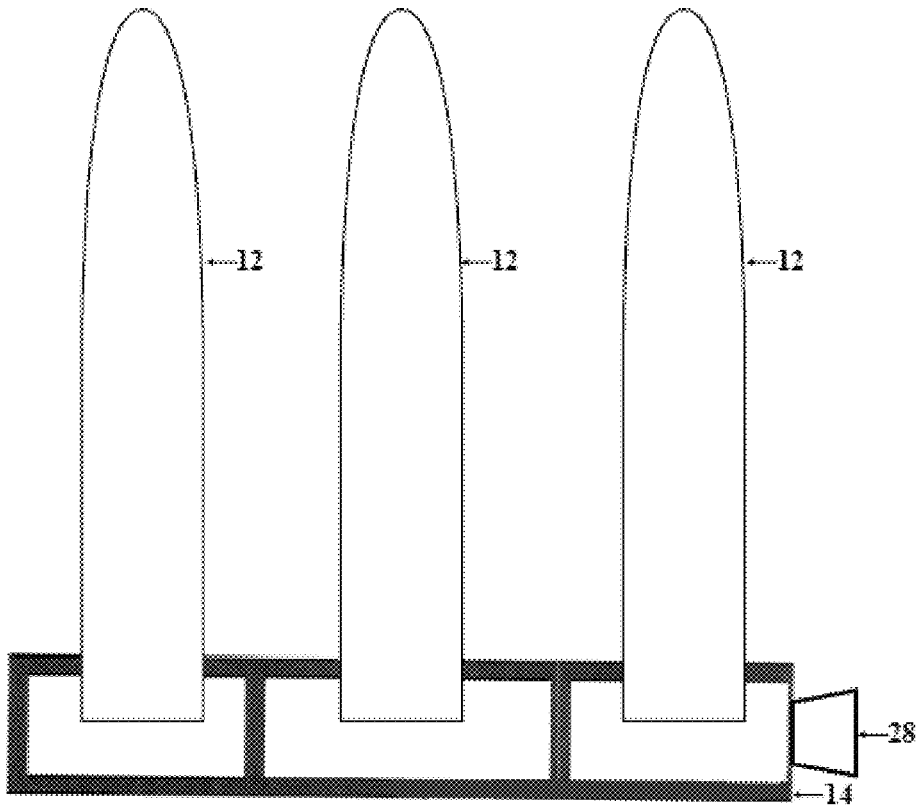
FIG. 6 is a side sectional view of support tubes with multiple rows.

As shown in the exemplary embodiment in FIG. 6, there are three connected plenum chambers 14 attached with three rows of support tube 12. The plenum chambers 14 may be interconnected to their own quick release valve 28 or the plenum chambers 14 may have openings (not shown) between each chamber where only one quick release valve 28 supplies air to the entire interconnected plenum chambers 14. The plenum chambers 14 may have couplers that may allow the plenum chambers 14 to be connected to each other. (not shown).

Figure 7A:
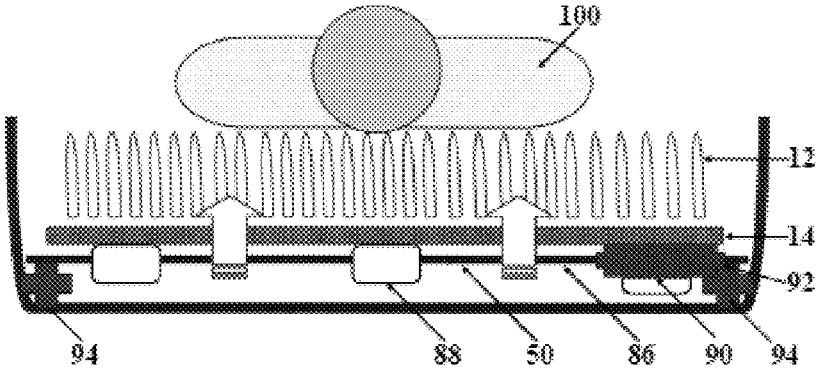
FIGS. 7A and 7B, shows an end view and a top view of the bed and the roller bar.
Figure 7B:
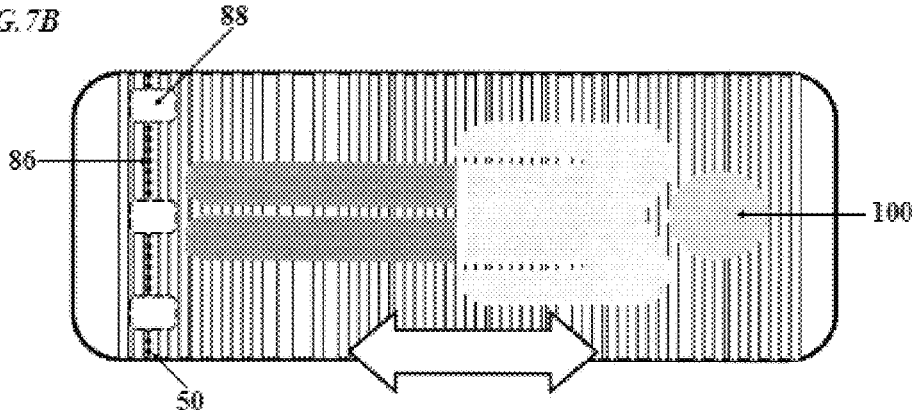

FIG. 7A. shows a cross sectional of an exemplary embodiment of the bed with the roller bar 50. The roller bar 50 may be comprised of an axle 86, roller bar cams 88, a servo motor 90, a drive belt 92, and track guides 94 in which the axle 86 or wheels disposed on the axel move along. As the roller bar 50 moves under a plenum chamber 14, the plenum chamber 14 along with the connected support tubes 12 are temporarily raised up, thereby providing stimulation to the patient 100. In FIG. 7B, the roller bar 50 may provide a full length wave motion 96 or provide a set of limited range motion 98 for more target stimulation on patient 100. In the alternative, the roller bar 50 may be stopped at a particular location to help raise the patient at certain bodily locations of the patient 100. The plenum chambers 14 may each have dampening strips attached to the bottom where the roller bar cams 88 make contact with the plenum chambers 14. Such dampening strips allow for smoother transition in the progress of the roller bar, thereby reducing any stress imposed by the roller bar on the patient 100.

Figure 8A:
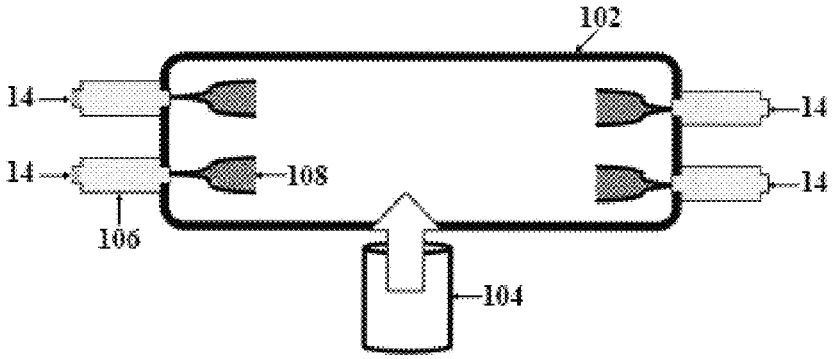
FIGS. 8A and 8B, is a set of side sectional views of the air equalization chamber.
Figure 8B:
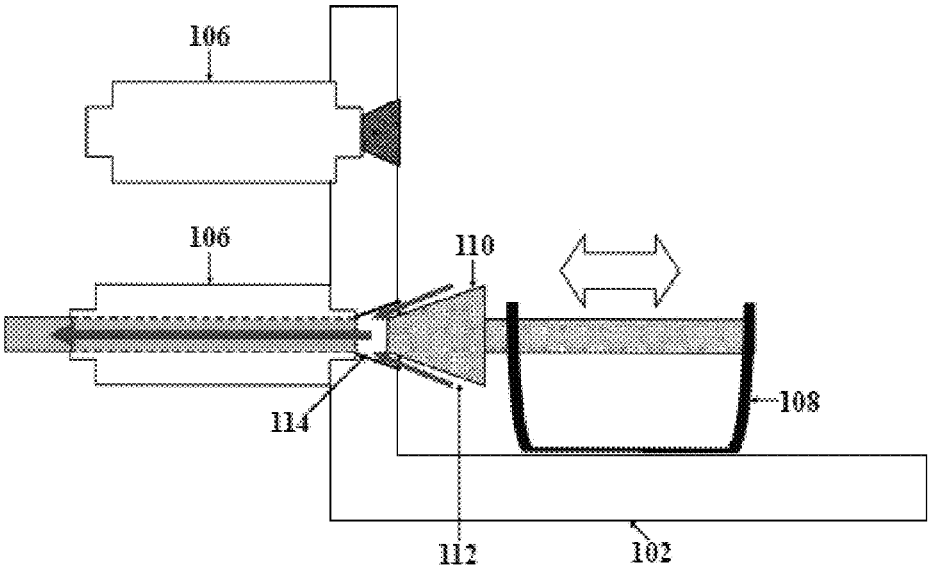

The stimulation by the support tubes or the roller bar may be used to provide alternating stimulation. As mentioned above, the roller bar may provide varying stimulation if the servo motor 90 is allowed to continually move the roller bar 50 up and down the bed in various ways. Further, some beds may be configured with multiple rows of support tubes thereby increasing stimulation in some areas that others. Air pressure may also be adjusted in some plenum chambers 14 as shown in FIG. 8A. In this exemplary embodiment of the air equalization chamber 102, an air pressure source 104, such as an electrical air pump, is connected to the air equalization chamber 102, and the air then flows through the connected air lines 106 to each of the connected plenum chambers 14. Individual plenum chambers may have adjusted air pressure by the use of a solenoid controlled valve 108. In FIG. 8B, a magnified view of the air equalization chamber 102 shows the solenoid 110 moving a valve 112 at varying depths into the air channel orifice 114. Air pressure may be controlled by other equivalent means known to those with ordinary skill in the art.

Figure 9A:
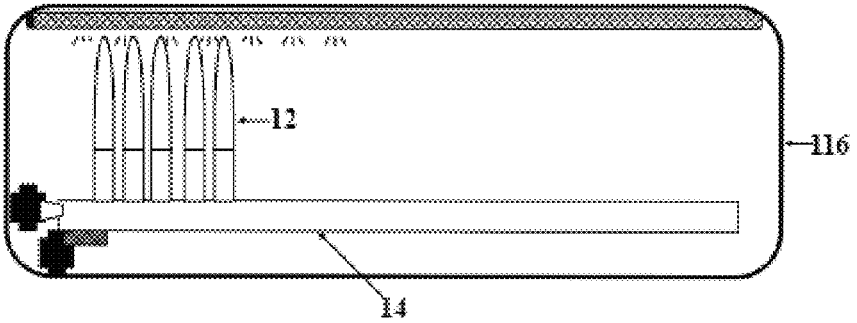
FIGS. 9A-C, is a set of side sectional view of the steps of sanitizing system of the support tube system.
Figure 9B:
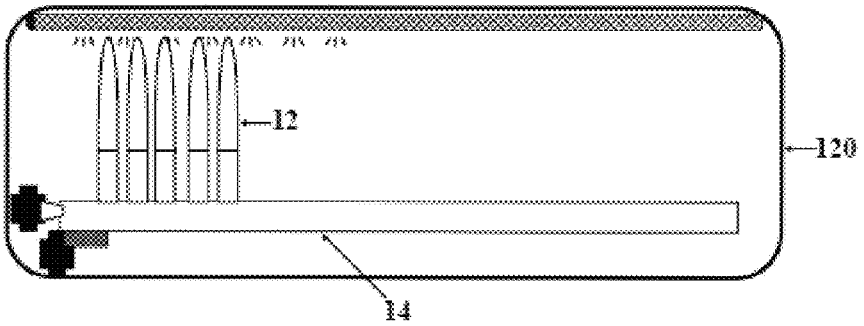
Figure 9C:
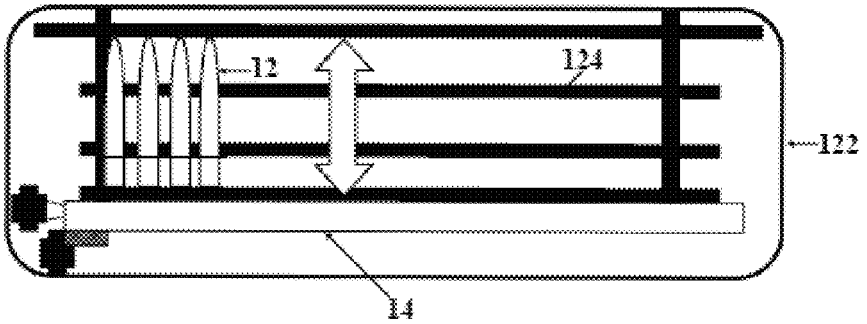

One or more rows of support tubes 12 may be removed from the bed and placed into a sanitizing system as shown in figures FIG. 9A-C. In the alternative, the entire bed may without the sheet 60 be placed into the system. FIG. 9A shows a portion of the support tubes 12 without the sheet 60, are placed into an enclosed soaking tub 116. The tub may be of a variety of different shapes and sizes that conform to the bed components to be sanitized. The soaking tub 116 has a liquid distribution line connected to the top interior ceiling of the soaking tub 116. The liquid may be antiseptic fluid, soap solution, or any other liquid material sufficient to decontaminate and loosen or remove any soiling on bed components (e.g. plenum chamber 14, tubes 12, etc.).

The rows of support tubes 12 along with other components may then be placed into an enclosed rinsing tub 120 as shown in FIG. 9B. After sufficient rinsing, the support tubes 12 and other bed components are placed into a enclosed third tub 122 wherein the third tub 122 blows hot and dry air in order to evaporate the residual liquid, and has a plurality of UV lights 124 which are configured to be placed at locations that can irradiate and eliminate any microorganisms and viral material that are left within the structure of the support tubes 12, and the associated bed components.

Each of the above tubs may have transparent lids, which allows the operator to evaluate whether the support tubes and attached bed components have been properly sanitized and cleaned.

A system and apparatus for providing a hospital bed to reduce bed sores and injuries along with a coupled sanitization system has been disclosed. Although the present invention has been described in terms of a preferred embodiment, it will be appreciated that various modifications and alterations might be made by those skilled in the art without departing from the spirit and scope of the invention. Therefore, the invention should be measured only in terms of the claims which follow.

I claim:

1. A bed comprising:

a) a frame wherein said frame includes a set of bars;

b) the said set of bars being configured to be plenum chambers, wherein said plenum chambers may be filled with air pressure;

c) the said air pressure coming from a source wherein each said plenum chamber is connected to said air pressure source;

d) a plurality of telescoping tubes connected to said plenum chambers;

e) each telescoping tube having an outer tube and an inner tube;

f) the each said inner tube having an opening near the inner tube's connection with the associated plenum chamber, said opening allowing air pressure from said plenum chamber to enter into the interior space of said inner tube;

g) the each said inner tube having an orifice facing its outer tube, said orifice passing air pressure from said inner tube into said outer tube;

h) said outer tube rising upwards above the top surface of the bed when filled with air pressure; and i) said outer tube having at least one orifice that releases some applied air pressure above the top surface of the bed.

2. The bed in claim 1 including valves located between said air pressure source and said plenum chambers for regulating said air pressure within said set of plenum chambers.

3. The bed in claim 1 wherein said plenum chambers have a sufficient number of said telescoping tubes wherein the number of telescoping tubes to provide comfortable support to the user of the bed.

4. The bed in claim 1 wherein each said outer tube has a collar near its base configured within the interior surface of said outer tube, and said inner tube has external fins located such that when said outer tube is raised, it is not raised beyond the location of said external fins.

5. The bed in claim 1 wherein said at least one orifice is located at the lateral side of said outer tube.

6. The bed in claim 1 wherein said aperture of said inner tube has a wider orifice than said at least one orifice of said outer tube.

7. The bed in claim 1 further including a sheet having a plurality of apertures adapted to receive said telescoping tubes, said plurality of apertures being configured to fit around each said telescoping tube.

8. The sheet in claim 7 is comprised of multiple layers where at least one layer is an absorbent material.

9. The bed in claim 1 wherein said frame has tracks positioned on opposite sides of the frame, said tracks being configured to receive a roller bar, wherein said roller bar may moved underneath said plenum chambers, said roller bar being positioned such that it raises said plenum chambers overlying said roller bar.

10. The plenum chambers and connected plurality of telescoping tubes of claim 1 being for placement into a sanitization system, said sanitization system comprising:

a) a first container configured to receive said plenum chambers and connected plurality of telescoping tubes for soaking in a sanitization liquid, b) a second container for rinsing said plenum chambers and connected plurality of telescoping tubes after sanitization liquid has been applied, and c) a third container for drying said plenum chambers and connected plurality of telescoping tubes.

11. The sanitizing system in claim 10 wherein said third container includes air lines to provide air to dry said plenum chambers and connected plurality of telescoping tubes.

12. The sanitizing system of claim 10 wherein said third container includes UV lamps.

13. A hospital bed for providing air pressure to a patient comprising:

a) including a set of bars;

b) the set of bars are configured to be plenum chambers;

c) the plenum chambers may be pressurized from an air pressure source wherein said air pressure source is connected to each said plenum chamber;

d) a set of valves for each said plenum chamber configured to control the air pressure of each plenum chamber through motorized means;

e) a plurality of telescoping tubes connected to said plenum chambers;

f) each said telescoping tube having an outer tube and an inner tube;

g) the each said inner tube having an opening near the connection with the associated plenum chamber, said opening allowing air pressure from said plenum chamber to enter into the interior space of said inner tube;

h) each said inner tube having an orifice facing said outer tube, said orifice passing air pressure from said inner tube to said outer tube;

i) said outer tube rising upwards above the top surface of said bed when filled with air pressure;

j) said outer tube having at least one orifice that releases some air pressure;

k) a sensing receiver located below the top surface of said bed for detecting a signal placed on specific location on a patient using said bed;

l) the said sensing receiver being connected to a computer programmed to control the valves of each said plenum chamber; for regulating the air pressure at the location in which the sensing receiver has detected the signal placed on the patient.

14. The plenum chambers and connected plurality of telescoping tubes of claim 13 being for placement into a sanitization system, said sanitization system comprising:

a) a first container configured to receive said plenum chambers and connected plurality of telescoping tubes for soaking in a sanitization liquid, b) a second container for rinsing said plenum chambers and connected plurality of telescoping tubes after sanitization liquid has been applied, and c) a third container for drying said plenum chambers and connected plurality of telescoping tubes.

15. The sanitizing system in claim 14 wherein said third container includes air lines to provide air to dry said plenum chambers and connected plurality of telescoping tubes.

16. The sanitizing system of claim 14 wherein said third container includes UV lamps.

17. The hospital bed in claim 13 further including a sheet having a plurality of apertures adapted to receive said telescoping tubes, said plurality of apertures being configured to fit around each said telescoping tube.

18. The sheet in claim 17 is comprised of multiple layers where at least one layer is an absorbent material.

19. The sheet in claim 18 wherein sheet includes the sensing receiver.

20. A hospital bed for providing air pressure to a patient comprising:

a) including a set of bars;

b) the set of bars are configured to be plenum chambers;

c) the plenum chambers may be pressurized from an air pressure source wherein said air pressure source is connected to each said plenum chamber.

d) a set of valves for each said plenum chamber configured to control the air pressure of each plenum chamber through motorized means;

e) a plurality of telescoping tubes connected to said plenum chambers;

f) each said telescoping tube having an outer tube and an inner tube;

g) the each said inner tube having an opening near the connection with the associated plenum chamber, said opening allowing air pressure from said plenum chamber to enter into the interior space of said inner tube;

h) each said inner tube having an orifice facing said outer tube, said orifice passing air pressure from said inner tube to said outer tube;

i) said outer tube rising upwards above the top surface of said bed when filled with air pressure;

j) said outer tube having at least one orifice that releases some air pressure;

k) said plenum chambers and connected plurality of telescoping tubes are removable from said hospital bed.

* * * * *